US007571496B2

(12) United States Patent
Martin

(10) Patent No.: US 7,571,496 B2
(45) Date of Patent: Aug. 11, 2009

(54) ROTATING POP UP POOL CLEANING HEAD

(76) Inventor: James H. Martin, 925 W. Mendoza Ave., Mesa, AZ (US) 85210

( * ) Notice: Subject to any disclaimer, the term of this patent is extended or adjusted under 35 U.S.C. 154(b) by 58 days.

(21) Appl. No.: 11/952,227

(22) Filed: Dec. 7, 2007

(65) Prior Publication Data

US 2009/0000021 A1 Jan. 1, 2009

Related U.S. Application Data

(60) Provisional application No. 60/937,661, filed on Jun. 29, 2007.

(51) Int. Cl.
*E04H 4/00* (2006.01)

(52) U.S. Cl. ..... 4/490; 239/206

(58) Field of Classification Search ..... 4/490, 4/488; 239/206–203, 201, 200
See application file for complete search history.

(56) References Cited

U.S. PATENT DOCUMENTS

| | | | | | |
|---|---|---|---|---|---|
| 3,655,132 | A * | 4/1972 | Rosic | 239/206 |
| 3,675,252 | A * | 7/1972 | Ghiz | 4/492 |
| 4,188,673 | A | 2/1980 | Carter | |
| 4,202,499 | A * | 5/1980 | Mathews | 239/206 |
| 4,347,979 | A | 9/1982 | Mathews | |
| 4,371,994 | A | 2/1983 | Mathews | |
| 5,251,343 | A | 10/1993 | Goettl | |
| 6,848,124 | B2 | 2/2005 | Goettl | |
| 6,899,285 | B2 | 5/2005 | Goettl | |

* cited by examiner

*Primary Examiner*—Huyen Le

(57) ABSTRACT

A pop up nozzle assembly useful for cleaning swimming pool surfaces is disclosed. The present invention includes a continuously rotating spray nozzle, a water driven impeller, gearing to move the pop up head, interchangeable heads, and means for returning back within the floor or wall. The present invention includes important features for efficient cleaning, easy removal for repair, and the prevention of vandalism.

6 Claims, 7 Drawing Sheets

ROTATING POP UP POOL CLEANING HEAD

CROSS REFERENCE TO RELATED APPLICATIONS

This application claims the benefit of U.S. Provisional Application No. 60/937,661 filed on Jun. 29, 2007.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION

1. Field of the Invention

The present invention is directed to swimming pool cleaning systems. In particular, it is directed toward improvements in swimming pool cleaning systems where dirt is agitated so that it can be removed by a swimming pool filtering system.

2. Description of Related Art

A high percentage of modern swimming pools and spas are designed with built-in automatic cleaning systems that consist of a plurality of floor, step, or wall embedded pop-up cleaning head assemblies. These assemblies are spaced throughout the pool to provide a means of cleaning the pool with a concentrated stream of water through a nozzle, slightly above and parallel to the pool floor or wall. Throughout the duration of the pool cleaning cycle, these nozzle heads which are normally flush with the floor surface, project and retract numerous times, each time incrementally rotating to a new cleaning position.

Through the means of a pump, filter and multi-ported distribution valve, the cleaning head assemblies are designed to pop up individually or in sets throughout the cleaning cycle of the pool at predetermined intervals. As high pressure water flow from the pump and distribution valve is introduced to the nozzle head, it projects upward, locks in position and cleans an area adjacent to the nozzle position. This action intends for accumulated debris in that particular area to be moved or suspended, then ultimately removed from the pool through the main drain or skimmer by the pool filtering system.

A common problem associated with an indexing nozzle head, is it's tendency to push a portion of the dirt and debris from its present position into an area it had previously cleaned.

Because these heads are stationary while in the cleaning mode, currents are created which move the suspended debris into areas that are calm and inactive such as corners, steps, or up walls where the dirt then settles and remains in the pool. At times, a star burst type of dirt pattern remains around these types of cleaning heads. It is highly noticeable in a lighter colored pool.

Although cleaning heads of this type improve the ability of a pool to clean itself, thorough cleaning is not accomplished. The pool owner or pool maintenance company will typically have to manually brush the remaining dirt and debris. This is very unsatisfactory for a pool owner.

Although most related art concerns the indexing or random-stop type cleaning head, one example of a constant rotation, gear and impeller drive system is U.S. Pat. No. 4,347,979. The design is lacking in important areas:

1) The high number of internal reduction gears create significant frictional drag and the possibility of part failure is substantially increased.

2) Designed water passages through the head assembly allow direct flow into the gear chamber and other areas of close tolerance, this results in gear jambs and/or complete plugging by debris that may be introduced.

3) The complicated design and technique for removal of the cleaning head makes cleaning and maintenance of the cleaning head virtually impossible for the typical pool owner.

4) There are a large number of elements which cause it to be unduly complex and expensive to manufacture.

BRIEF SUMMARY OF THE INVENTION

The present invention may be described as an assembly providing an efficient means of cleaning the inner surfaces of a swimming pool or spa. The present invention comprises a pop-up cleaning head assembly for a swimming pool or spa, including an impeller and gear set, which provides a mechanical means of constant rotation of the nozzle housing when pressurized by a flow distribution valve associated with a pump. The nozzle housing includes a relatively large diameter nozzle orifice for producing an efficient jet stream parallel to the floor or wall surface. For areas needing less water flow to clean, such as steps or built-in benches, interchangeable pop up heads with suitable orifices may be easily installed.

The primary object of the present invention is to provide a pop-up cleaning head for a swimming pool or spa that will thoroughly and more efficiently suspend and transfer dirt and debris from all parts of the pool floor and walls, substantially improving the removal of debris by the pool filtering system.

Another object of this invention is to provide a pop-up head that, during each active cleaning cycle, has a nozzle in constant rotational motion capable of cleaning a full 360-degree area surrounding the head.

Another object of this invention is to provide a pop-up head that will insure the removal of dirt and debris typically missed by incrementally positioning heads that re-position dirt more than suspend and remove it.

Another object of the invention is to provide a means of protection for mechanical components such as the gear system from vandalism or inadvertent stresses applied to the exposed rotary head and nozzle during its active popped-up configuration. Briefly described, and in accordance with one embodiment thereof, the invention provides a means of separation by dividing the rotating nozzle cover into two frictionally connected halves. This feature allows the upper exposed nozzle half to be independently turned or stopped without damage to the bottom portion that is mechanically engaged.

Another object of the invention is to provide an interchangeable low-flow nozzle cover with a plurality of nozzle orifices for areas such as steps or built in benches of less than 8 inches depth. A less powerful stream is necessary to clean such relatively small areas. Because the cleaning head must be mounted in close proximity to the sidewall of the top step or bench, turbulence normally occurs when the stream is directed toward the sidewall causing a noisy fountain effect as water is forced upwardly breaking the surface. By providing a nozzle head cover with a plurality of orifices, to be precise, a pair of nozzle orifices directly opposite, allow pressure to be dispersed equally, reducing or eliminating the negative effects of a single orifice nozzle.

Finally, an important object of this invention is to provide a cleaning head capable of cleaning the same area in a fraction of the time it takes a conventional indexing head. Consequently, the total cleaning period can be shortened significantly, saving energy costs and wear-and-tear on pool equipment.

BRIEF DESCRIPTION OF THE SEVERAL VIEWS OF THE DRAWING(S)

Figure 13B:
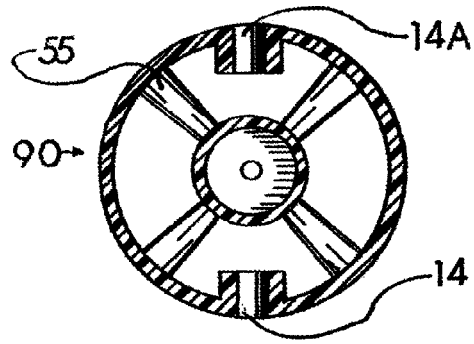
FIG. 13 is a cutaway view illustrating components of the two piece nozzle housing.
Figure 13:
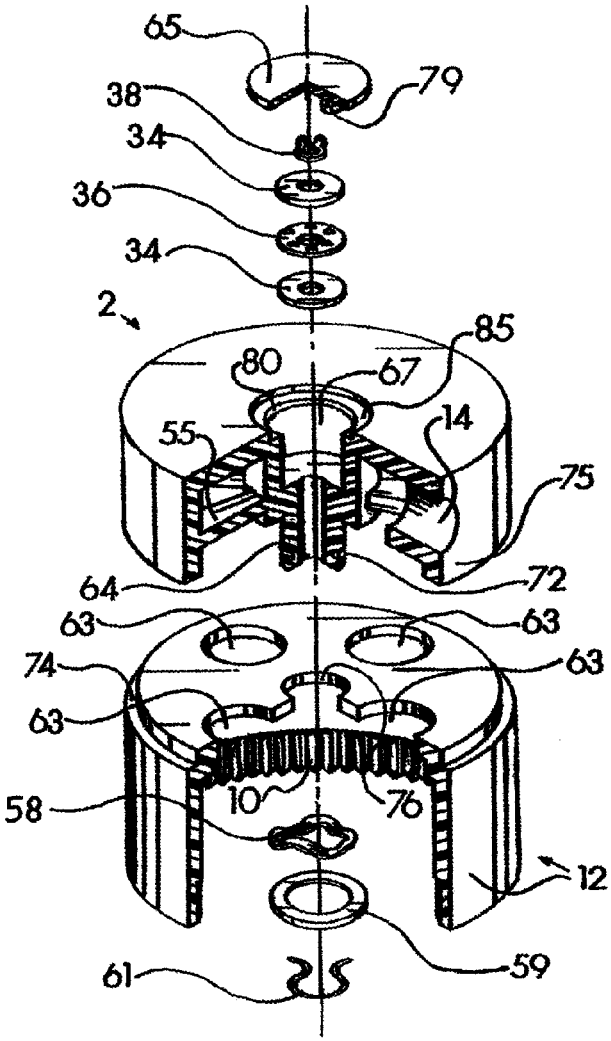
Figure 13A:
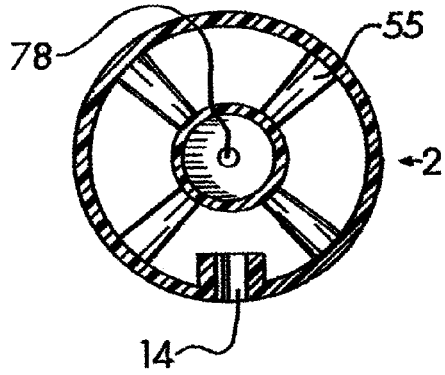
Figure 13C:
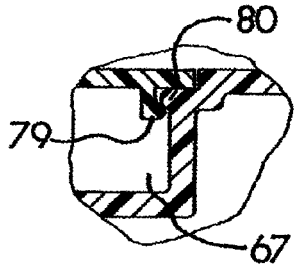

FIGS. 13A, 13B, and 13C show additional important details of the nozzle housing.

DETAILED DESCRIPTION OF THE INVENTION

The present invention is intended to be embedded in the floor of a swimming pool or spa, and optionally, a wall surface. It is designed to deliver a slowly revolving jet of water under pressure in a powerful, sweeping manner for the purpose of disturbing sediment and debris in the area surrounding the invention. This action causes the dirt and debris to be mixed or suspended in the water for eventual removal by the filtering system. The size of the pool determines the number of cleaning heads for thorough cleaning of its surfaces. In the practice of the invention, two or more cleaning heads are grouped together in a set designed to clean a certain area or zone. The number of heads in a set is in relation to the size of the pool pump. Typically, a large pump will sustain three to five heads in a set before losing cleaning efficiency, and the number of sets in a pool is dependant on the area to be covered. Heads within a set are precisely spaced to provide optimal coverage by the rotating jets of water. Although the heads in a particular set are individually piped, they have a common supply pipe connected to one of several ports exiting a sequencing distribution valve. The pool pump provides water under pressure to operate the distribution valve which opens each port sequentially, insuring that only one zone is activated at a time for optimum efficiency.

All components, unless otherwise indicated, are preferably made of high strength plastic, are injection molded, and made from a material type unaffected by pool chemicals or UV light. All metal parts will be of stainless steel, brass, or other metal suitable for sustained use in a pool environment.

To provide assistance to the reader, Table 1 is a list of part numbers with their names.

TABLE 1

| | |
|---|---|
| 1 | pop-up head assembly |
| 2 | upper nozzle housing |
| 3 | gear chamber |
| 4 | water chamber |
| 5 | cylindrical gear supports |
| 6 | annular lip |
| 7 | pop-up head |
| 8 | head retainer |
| 9 | upper section |
| 10 | ring gear |
| 11 | lower section |
| 12 | lower nozzle housing |
| 13 | locking channels |
| 14 | nozzle orifice |
| 15 | aligning lugs |
| 16 | floor fitting |
| 17 | center shaft |
| 18 | impeller |
| 19 | impeller shaft |
| 20 | upper lip |
| 21 | shaft support block |
| 22 | gear shaft |
| 23 | gear plate |
| 24 | annular groove |
| 25 | water passage blocks |
| 26 | annular flange |
| 27 | blades |
| 28 | bores |
| 29 | flat key ways |
| 30 | spring locks |
| 31 | chamber |
| 32 | water supply pipe/conduit |
| 33 | split ring |
| 34 | thrust washer |
| 35 | cylindrical wall |
| 36 | thrust bearing |
| 37 | base floor |
| 38 | spring clip |
| 39 | annular shelf |
| 40 | worm gears |
| 41 | threaded holes |
| 42 | large bevel gear |
| 43 | openings |
| 44 | Small bevel gear |
| 45 | main body |
| 46 | pins |
| 47 | annular lips |
| 48 | bores |
| 49 | spur gears |
| 50 | reduction gear set |
| 51 | screws |
| 52 | bevel flange |
| 53 | beveled seat |
| 54 | groove |
| 55 | spaced ribs |
| 56 | shaft housing |
| 57 | Flat key ways |
| 58 | friction washer |
| 59 | flat washer |
| 60 | weights |
| 61 | retainer clip |
| 62 | annular seat |
| 63 | water passage bores |
| 64 | shaft |
| 65 | center cap |
| 66 | supports |

TABLE 1-continued

| | |
|---|---|
| 67 | cylindrical recess |
| 68 | center bore |
| 69 | center bore |
| 70 | concrete floor or wall |
| 71 | pool plaster/finish material |
| 72 | lower perimeter groove |
| 73 | lateral strengtheners |
| 74 | recessed annular shelf |
| 75 | annular lip |
| 76 | center bore |
| 77 | spring |
| 78 | central bore |
| 79 | attachment tabs |
| 80 | ring projection |
| 81 | key way stops |
| 82 | relief ports |
| 83 | head removal tool |
| 84 | retainer recesses |
| 85 | annular shelf |
| 86 | round headed steel pins |
| 90 | upper nozzle housing |

Figure 1:
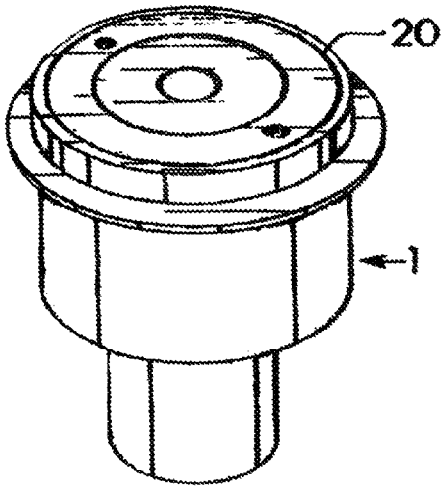
FIG. 1 is a perspective view of the pop-up head assembly according to the present invention.

FIG. 1 illustrates the pool cleaning pop-up head assembly 1 including an upper lip 20 that is flush with the floor or wall surface of the pool.

Figure 2:
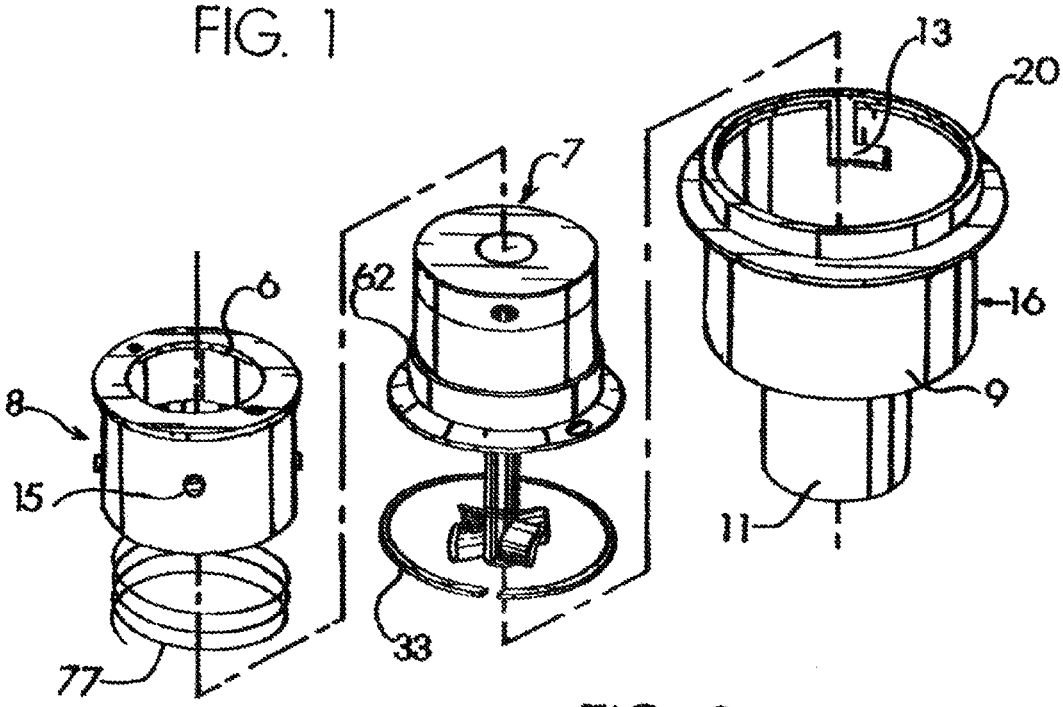
FIG. 2 is an exploded perspective view of the present invention shown in FIG. 1, illustrating assembly order for major components.

FIG. 2 is an assembly illustration of the pop up pool cleaning head assembly which includes three principal components: a floor fitting 16, a pop-up head 7, and a head retainer 8. The floor fitting 16 is comprised of a large upper section 9 cylinder which is installed in the swimming pool wall or floor and a smaller lower section 11 cylinder. The lower section 11 is used as an attachment sleeve for securing to the water supply pipe 32 by a suitable adhesive, or other attaching means such as a screwed fitting or bolted fitting. The pop-up head 7 lifts out of the floor fitting 16 when used during water flow. The head retainer 8 prevents the pop up head from completely sliding out when used. The head retainer 8, floor fitting 16, split ring 33, and spring 15 are part of a fixed floor insert assembly for the pop up head 7, which does not rotate during the cleaning cycle.

Figure 1A:
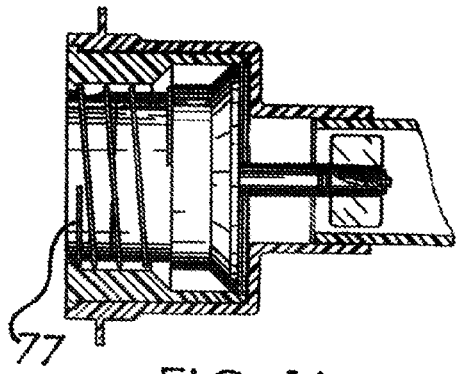
FIG. 1A is a cross sectional view of the present invention shown in the wall mounted configuration with optional spring.

Side view FIG. 1A illustrates the present invention in a horizontal, wall mounted configuration having a spring 77 installed for retraction of pop up head 7 instead of a more reliable weighted retraction system normally used in a vertical floor mounting.

FIG. 2 illustrates the assembly of the present invention's major components. Coil spring 77 is loosely fitted over pop up head 7 and rests upon annular seat 62 and is fitted inside head retainer 8 loosely over the spring till the upper coil of the spring rests against annular lip 6. Compressing the spring by pushing upward on the pop up head 7 allows the insertion of split ring 33 into annular groove 24 thereby removably securing the head within the retainer. Once the head, spring and retainer are assembled, they are lowered into the floor fitting 16 by aligning lugs 15 with L-shaped locking channels 13 and rotating clockwise to the secured position. Removal would be the reversal of these steps.

Figure 3:
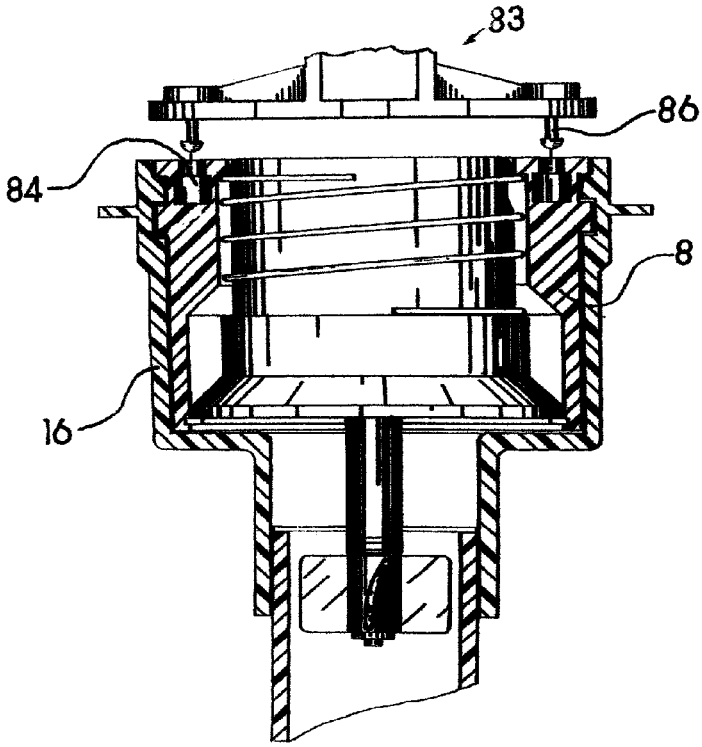
FIG. 3 is a sectional view of the head removal tool in application.
Figure 4:
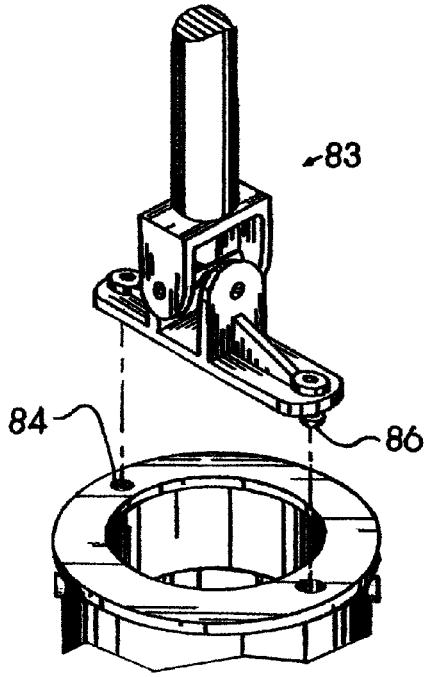
FIG. 4 is a perspective view showing design elements of a head removal tool.

For clarity, FIGS. 3 and 4 show a side view and a perspective view respectively of a head removal tool 83 used to manipulate head retainer 8 by engaging round headed steel pins 86 with retainer recesses 84. An interlocking situation occurs when head removal tool 83 is turned to either remove or replace the head and retainer assembly into floor fitting 16.

Figure 5:
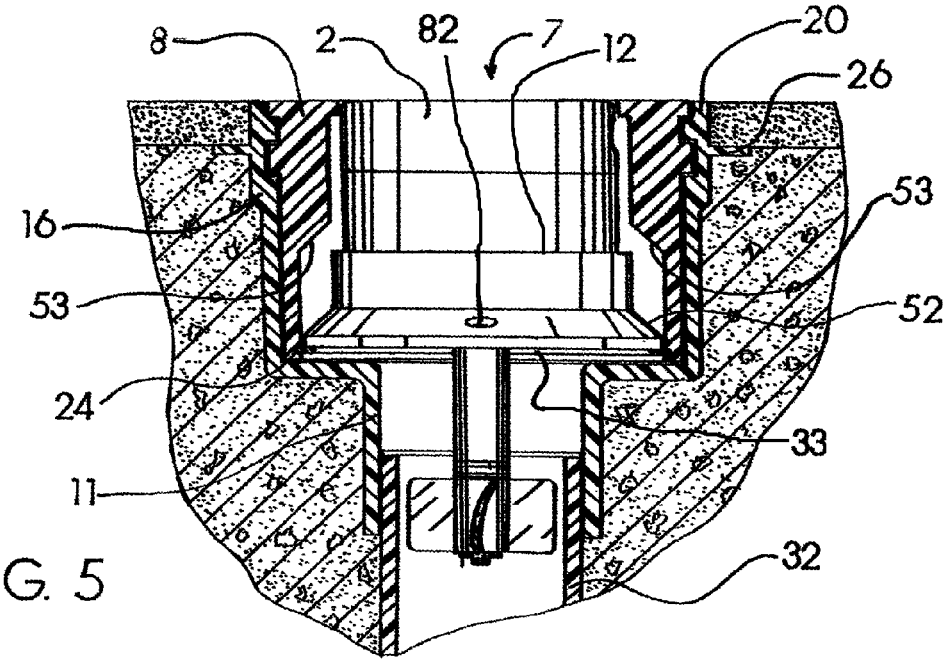
FIG. 5 is a sectional view of the pop-up fitting in the lowered, non-pressurized state.
Figure 6:
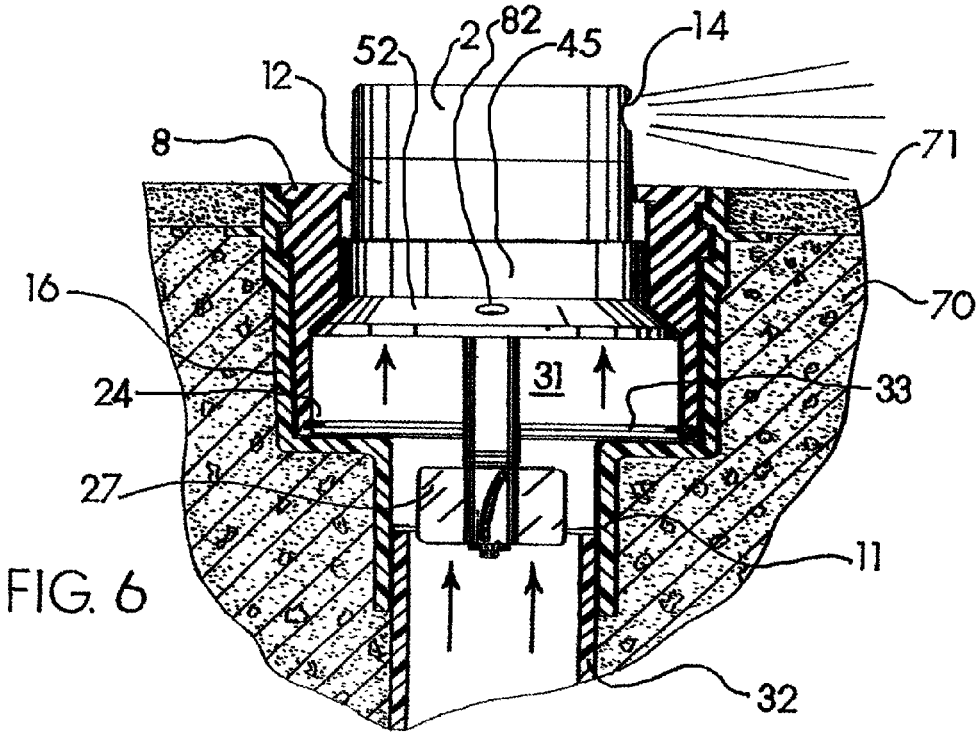
FIG. 6 is a sectional view of the pop-up fitting in the raised, water under pressure state.

FIGS. 5 and 6 show sectional side views of the floor fitting 16, head retainer 8, and pop up head 7 installed in a concrete pool floor. Because a retraction system using weights has proven more reliable in general, a spring for retraction of pop up head 7 in a non vertical installation is not preferable. During pool construction, the floor fitting 16 embedded within the concrete floor or wall 70, and is attached to the water supply pipe 32 by an adhesive connection to the lower section 11. An annular flange 26 is used primarily as a guide during pool construction to determine the correct depth for a particular thickness of concrete floor 70 and pool plaster or finishing material 71. FIG. 5 shows pop up head 7 in the retracted position with the upper surface of upper nozzle housing 2 substantially flush with the pool floor surface.

Figure 9:
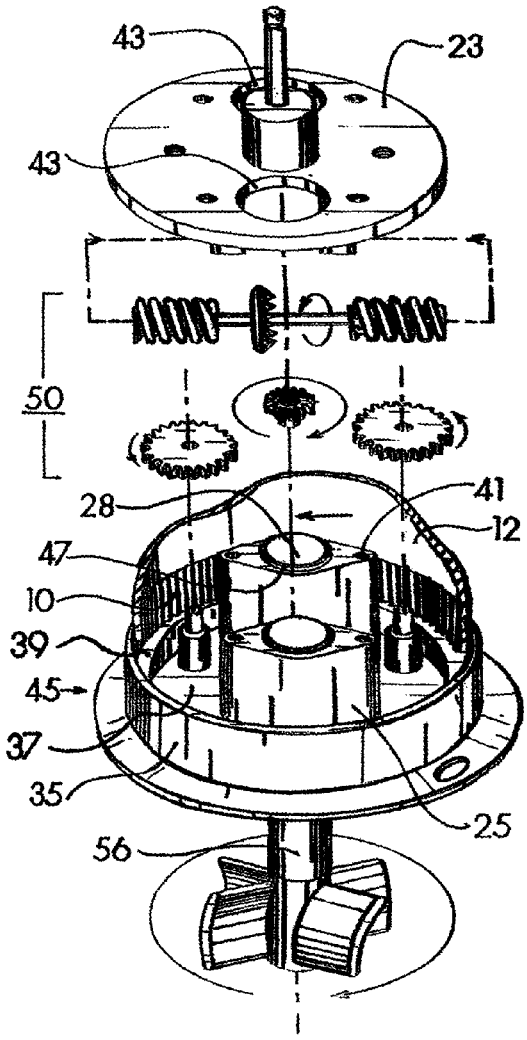
FIG. 9 is an exploded perspective view of the gear system within the head unit.

As illustrated in FIG. 6, when water is actively flowing, the water comes from the pool pump, is piped through a distribution valve (not shown), which cyclically provides water under pressure through water supply pipe 32. A relatively close water passage around blades 27 is used to insure a rotation of the blades. Water flow is indicated by arrows. The exploded perspective view of FIG. 9, shows the rotation of impeller 18 is ultimately transferred by means of a reduction gear set 50 to a ring gear 10 molded into the lower inside wall of nozzle housing 12.

Referring again to FIG. 6, the rotation of the lower nozzle housing 12 and rotatably attached upper nozzle housing 2, provides a sweeping jet of water from nozzle orifice 14 in a radial manner with a productive cleaning diameter of eight to ten feet. Turbulence produced from each set of rotating heads quickly loosen debris on the floor surface, suspending and mixing it with pool water to be filtered.

Figure 8:
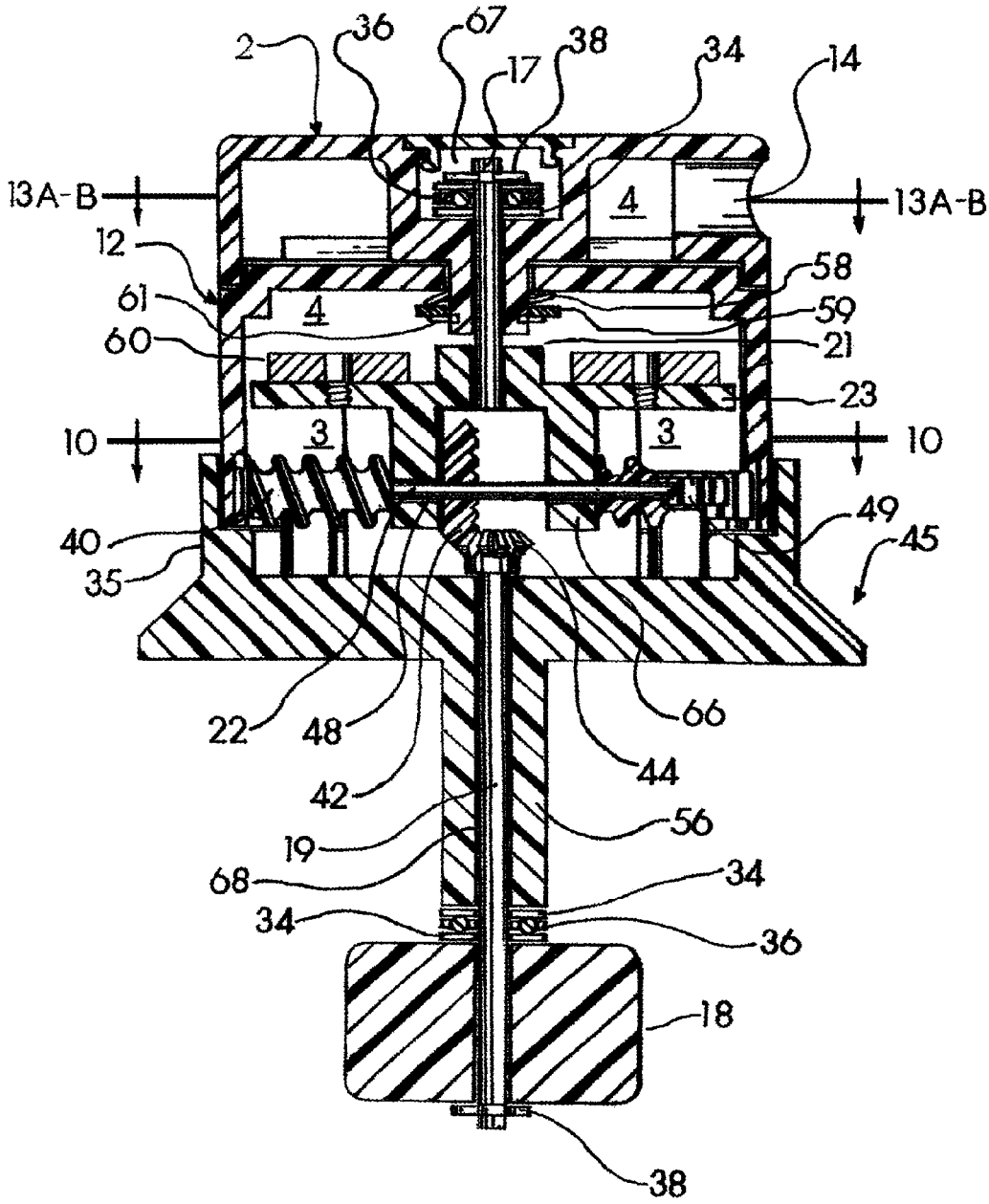
FIG. 8 is a cross sectional view showing internal drive gearing.

Referring once again to FIGS. 5 and 6, during the start of each activation period and upon entering chamber 31, water under pressure forcibly lifts pop up head 7 until the annular beveled flange 52, having a top surface downward bevel of 45 degrees, engages with a complimentary beveled seat 53. This engagement then stops the lift and creates a positive seal between the pop up head 7 and the head retainer 8. The bevel flange 52 has an annular bottom surface parallel to, and resting upon, split ring 33 when in the retracted position as shown in FIG. 5. When the pop up head 7 is fully extended, the main body 45 is essentially locked in a stationary position while the nozzle housings 2, 12 rotate with the nozzle orifice 14 which is now exposed above the surface to be cleaned. As the bevel flange 52 and the bevel seat 53 engage, a perimeter seal is created and the water flow is forcibly directed upwardly through bores 28, shown in FIGS. 9, 10 and 11. The water bypasses gear chamber 3, as illustrated in FIG. 8, and flows directly into the upper water chambers 4 where it then pressurizes and exits nozzle orifice 14 as a cleaning jet. The bypass of water around gear chamber 3 is an important feature that minimizes the chance for debris from clogging any gearing.

Figure 7:
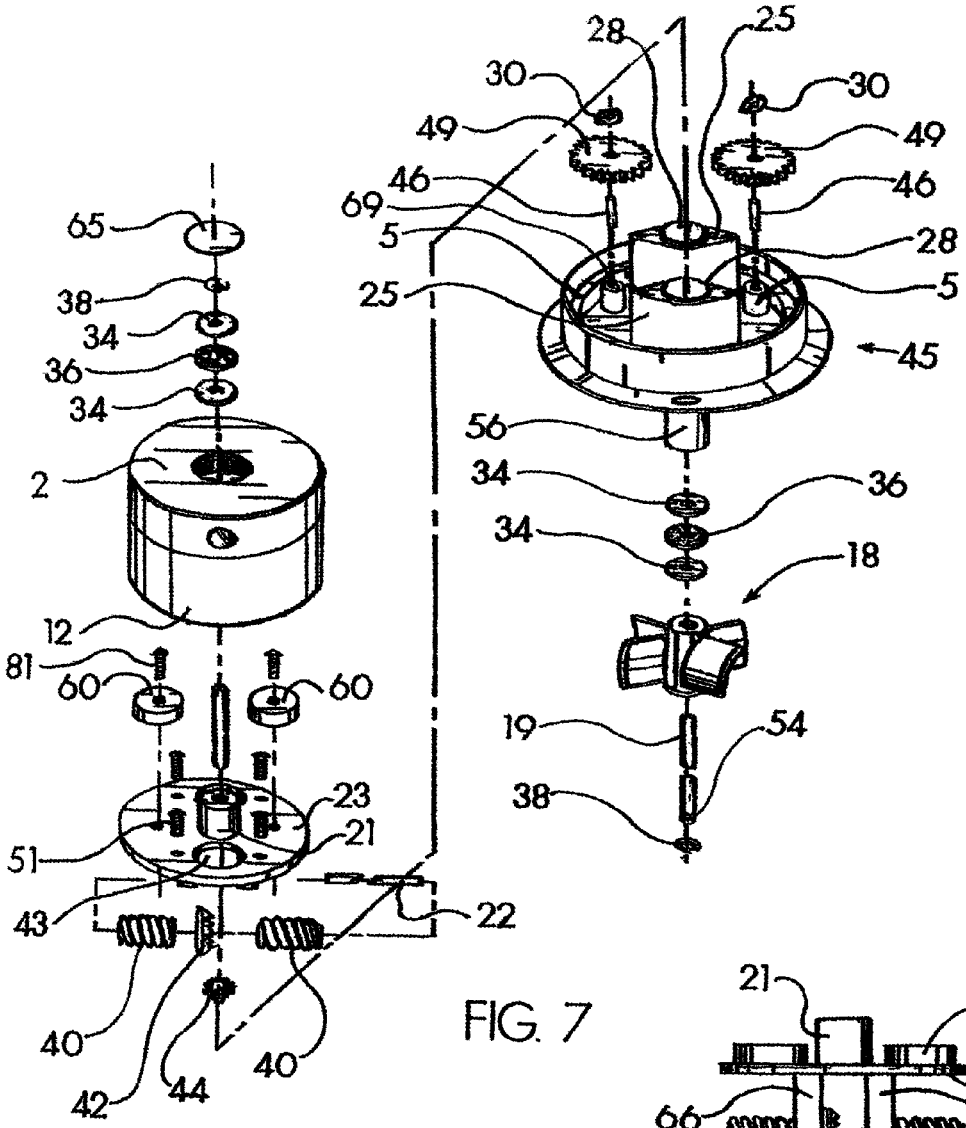
FIG. 7 is an exploded assembly view of the pop-up head.
Figure 7A:
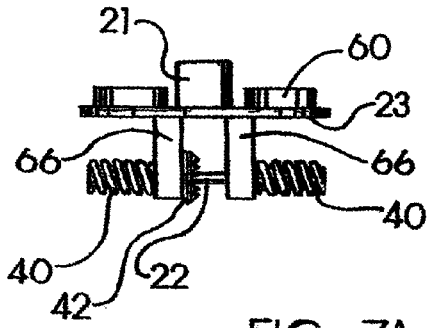
FIG. 7A is a side view showing a detail of bevel and worm gears.

Upon cessation of water flow, weights 60, shown in FIGS. 7, 7A, and 8, provide a downward force to keep pop-up head 7 fully retracted. The retraction prevents any inadvertent vertical lift resulting in a toe stubbing situation. Because the water supply distribution valve sometimes leaks and allows a small amount of water flow, a partial lift is possible. However, the present invention prevents this by use of a plurality of relief ports 82 in bevel flange 52 to allow this water to escape without lifting the head. Relief ports 82 are effectively sealed by bevel seat 53 when fully extended as seen in FIG. 6.

Figure 12:
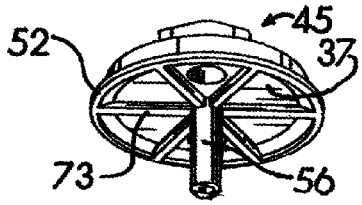
FIG. 12 is a bottom perspective view showing strengthening elements of the main body.

The main body 45, as shown in FIGS. 8, 9, and 12, is preferably an injection molded composite with elements including a cylindrical wall 35, that is perpendicular to a base floor 37, and functions as a stationary outer sleeve with a contained lower nozzle housing 12 and rotates during the cleaning cycle. An annular shelf 39 as seen in FIG. 9 is molded as a solid ring at the base of the cylindrical wall 35 with its top planar surface considered a non positive seal for a gear chamber 3 when the lower nozzle housing 12 is rotatably secured as seen in FIG. 8. Adequate clearance is provided between the bottom lip of lower nozzle housing 12 and adjoining annular shelf 39 which allows for rotation while still protecting the gear chamber 3 from debris infiltration. By being molded as a structural part of a cylindrical wall 35, the annular shelf 39 adds stability to the wall by reducing its overall freestanding height. FIG. 12 is a bottom perspective view of main body 45 showing a plurality of lateral strengtheners 73 which extend downwardly from the bottom surface of base floor 37, and provide additional strength and stability to shaft housing 56 and bevel flange 52.

FIGS. 7 and 9 show a pair of water passage blocks 25, formed as part of main body 45, and can be described as molded, elongated diamond shaped blocks as viewed from above. Each has a centrally located vertical bore 28 extending through the bottom of main body 45, allowing water under pressure to bypass gear chamber 3 and flow directly into water chambers 4 shown in FIG. 8.

Figure 10:
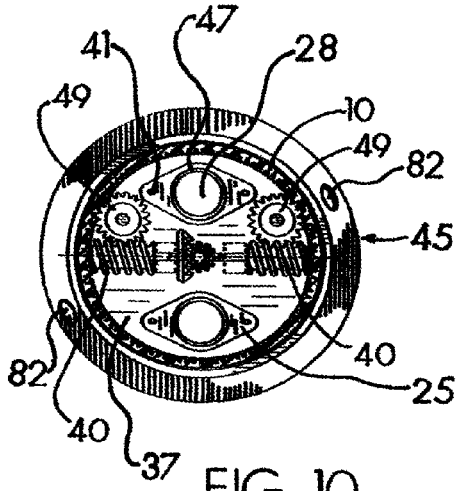
FIG. 10 is a downward cross sectional view taken along lines 10-10, as shown in FIG. 8.
Figure 11:
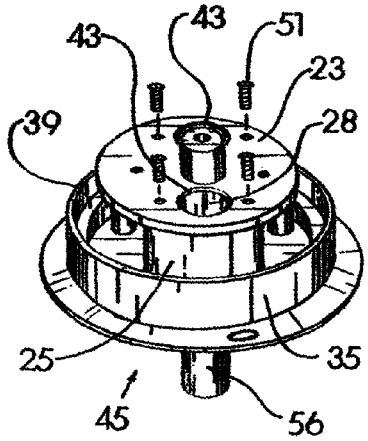
FIG. 11 is a perspective view of the gear plate mounted on the main body.

The upper planar surfaces of water passage blocks 25 as shown in FIGS. 9 and 10, display annular lips 47 formed around bores 28 functioning as alignment guides during assembly and fit into openings 43 of a gear plate 23. A plurality of threaded holes 41, secure the gear plate 23 using screws 51 as seen in FIG. 11.

In FIG. 8, a centrally located shaft housing 56, is formed as part of the main body 45 and is a vertically elongated cylinder extending downwardly having a bore 68 to rotatably contain the impeller shaft 19 and terminate with a planar bearing surface for a thrust washer 34.

Referring again to the exploded view of pop-up head 7 in FIG. 7, a pair of cylindrical gear supports 5 are part of the main body 45 and have a center bore 69 which contains adhesively secured pins 46 and provides a planar bearing surface for intermediate spur gears 49. The spur gears 49 are rotatably and removably secured to the pins 46 by spring locks 30.

A gear plate 23 as seen in FIGS. 7, 7A, and 8 is essentially a thick, molded circular disk used as an attachment plate providing the means to secure and align most elements of the pop-up head assembly. As shown in FIG. 8, it is positioned as a separator between and acting as an upper seal for the gear chamber 3 and provides a lower seal for water chamber 4. It should be understood that it is not considered a water tight seal, but a close fitting of the inner wall surface and the lower nozzle housing 12. This prevents debris infiltration to gear chamber 3 while still providing adequate clearance for rotation of the housing during its cleaning cycle. As seen in FIGS. 7, 9, and 11, the gear plate 23 is provided with a pair of openings 43 as an alignment aid, and formed as annular ports removably fitting annular lips 47 during assembly. The gear plate 23 is removably secured to water passage blocks 25 by a plurality of screws 51 and corresponding threaded holes 41.

Referring now to FIG. 8, a shaft support block 21, located on the upper surface and formed as part of plate 23, has a central bore to receive and adhesively secure a center shaft 17 which protrudes partially into recess 67 of the upper nozzle housing 2. Within recess 67, thrust washers 34 and thrust bearing 36 are removably disposed on center shaft 17 in the order shown and secured by spring clip 38 which rotatably and removably attaches nozzle housings 2, 12 to the pop up head.

Figure 7B:
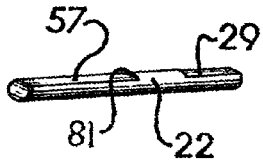
FIG. 7B is a perspective view showing additional gear shaft details.

FIG. 7A and FIG. 8 show shaft supports 66, perpendicular to the lower face and molded as part of the gear plate 23. They can be defined as rectangular blocks extending downwardly having horizontal bores 48 to rotatably contain gear shaft 22. The bores are such that the rotational axis of gear shaft 22 is centered over and perpendicular to the axis of impeller shaft 19 resulting in an engaged 90-degree relationship between large bevel gear 42 and small bevel gear 44. FIG. 7A shows the gear plate 23 having worm gears 40 and a large bevel gear 42 assembled and frictionally secured to flat key ways 57, 29 of gear shaft 22 as seen in FIG. 7B. When the gear shaft 22 slides into bores 48 during assembly, the large bevel gear 42 is frictionally secured on the longer flat key way 57 in an off-center configuration with respect to the vertical centerline between supports 66. Key way stops 81 create a fixed position for the worm gears 40 and large bevel gear 42, maintaining necessary clearances in relation to supports 66 to ensure rotation without interference.

The exploded perspective view of FIG. 7 the and cross-sectional view of FIG. 8, show the components which comprise the pop-up head in the unassembled and assembled state respectively. The small bevel gear 44 is adhesively secured to the top of impeller shaft 19, which rotatably rests upon the floor of the main body 45 after being inserted into the center bore 68 of the shaft housing 56. The impeller shaft 19 extends beyond the bottom of the shaft housing 56 to accept thrust washers 34, a thrust bearing 36 and an impeller 18. The impeller shaft 19 is removably secured by a spring clip 38 slid into a groove 54.

Although a single, one piece nozzle housing could be used as a rotating element for dispersing the water jet, a preferred embodiment is to create a two piece nozzle which rotates, but allows for inadvertent manual manipulation. It is known that swimmers in a pool will be curious about a cleaning mechanism, and are likely to explore its operation by trying to rotate it. Consequently, it is preferable to design a pop up head to separate the internal rotating mechanics of the present invention from the exposed nozzle housing. The present invention provides for a solution utilizing a two-piece nozzle housing which is frictionally and rotatably joined together.

FIG. 13 is an exploded perspective view with cutaways showing the various elements of the upper nozzle housing 2 and the lower nozzle housing 12. The upper nozzle housing 2 is preferably a composite structure, molded as a relatively short cylinder having a planar top with a cylindrical recess 67 centrally disposed to accept thrust washers 34, a thrust bearing 36, and a spring clip 38. A shaft 64 projects downward from the lower portion of recess 67 which provides a central bore 78 and a lower perimeter groove 72. A plurality of spaced ribs 55 are disposed within and perpendicular to the cylinder walls and recess 67 as shown in FIGS. 13 and 13A, which add stability to the outer walls and prevent flexing during pressurized periods. The lower nozzle housing 12 is a relatively large, planar topped cylinder with a plurality of water passage bores 63 dispersed radially and adjacent to center bore 76. The cylinder has an open bottom which provides for an internal ring gear 10 corresponding to the reduction gear set 50 as shown in FIG. 9 and engaged with spur gears 49 as shown in FIG. 10. In FIG. 13 the nozzle housings 2, 12 are joined by inserting a shaft 64 into a center bore 76 until the annular lip 75 is rotatably and frictionally contained within the recessed annular shelf 74. By securing the assembly with a friction washer 58 and a flat washer 59, and then inserting retainer clip 61 into lower perimeter groove 72, a perimeter seal is created. This forces incoming water to flow upwardly through water passage bores 63 into the upper water chamber 4 as shown in FIG. 8, where it exits nozzle orifice 14 as a cleaning stream. As seen in FIGS. 13 and 13C, after assembling the components of the pop up head, a center cap 65 can be secured to the annular shelf 85 by snapping attachment tabs 79 over a formed ring projection 80.

A common problem associated with pop-up heads located on a top step or a shallow seat is a fountain effect when the nozzle is directed at the perimeter wall of a pool. The pop up head is located only inches from the wall, causing the high pressure water stream to strike the wall and divert upwards. This causes the water stream to significantly disturb the water surface, which creates an annoyance. Existing technology cures include using a small orifice nozzle to reduce the volume of water, which also reduces cleaning ability. An alternative to reducing the nozzle orifice size is shown in FIG. 13B by a top sectional view of the present invention. The standard single orifice upper nozzle housing 2 as shown in FIG. 13A is replaced with alternate nozzle upper housing 90 as shown in FIG. 13B. The alternate nozzle upper housing 90 has two diagonally opposed nozzle orifices 14 and 14A, which reduces the water pressure at each orifice by half, eliminating the fountain effect without losing volumetric efficiency.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

I claim:

1. A rotating cleaning assembly useful for cleaning the inside surface of a pool by agitation comprising:

a. a pop up head including three aligned parts in order: an upper piston, a middle cylindrical portion, and an annular beveled flange, b. wherein said three aligned parts are each longitudinally aligned to an axis, c. wherein said upper piston and said middle cylindrical portion are closely adjacent and are connected together by friction in a manner to allow both to independently rotate about said axis, d. wherein said annular beveled flange is closely adjacent to said middle cylindrical portion, e. at least one nozzle opening on the radial surface of said upper piston, f. an impeller, impeller shaft, and mechanical gearing disposed to cause said upper piston and said middle cylindrical portion to rotate around said axis when water flows around said impeller, wherein said impeller shaft is substantially parallel to said axis, g. an insert assembly which contains said pop up head, wherein said insert assembly is placed substantially within a floor or wall of said pool, h. an intermittent water flow from a pump source to said insert assembly, i. wherein said axis is substantially perpendicular to said floor or said wall, j. wherein when said water flow is active, i) said pop up head moves out of said insert assembly along the direction of said axis, ii) said insert assembly restricts the motion of said pop up head out of said insert assembly to a fixed distance, iii) wherein said annular beveled flange and said insert assembly contact in a manner to provide a significant water sealing contact, iv) said impeller rotates about said impeller shaft by the motion of said water flow, and v) a substantial amount of said water flow exits out of said at least one nozzle opening perpendicular to said axis, and k. wherein when said water flow is inactive, i) said pop up head is retracted into said insert assembly by use of a spring or weight, and ii) said pop up head is substantially flush with said floor or said wall, whereby the water flow through said at least one nozzle opening provides for agitation along the inside surface of a pool.

2. The rotating cleaning assembly according to claim 1 wherein said pop up head is connected to said middle cylindrical portion by use of pins to provide for disassembly by a tool.

3. The rotating cleaning assembly according to claim 1 wherein said insert assembly comprises two parts, a fixed part that is rigidly attached to said floor or said wall, and a removable part that contains said significant water sealing contact.

4. The rotating cleaning assembly according to claim 3 wherein said insert assembly additionally includes said spring or said weight.

5. The rotating cleaning assembly according to claim 1 wherein a sweeping jet of water from said at least one nozzle opening has a productive cleaning diameter of at least eight feet.

6. The rotating cleaning assembly according to claim 1 wherein the majority portion of said water flow through said pop up head is directed through chambers so that it does not principally flow around said mechanical gearing.

* * * * *